US007675240B2

(12) United States Patent
Yang et al.

(10) Patent No.: US 7,675,240 B2
(45) Date of Patent: Mar. 9, 2010

(54) LIGHT EMITTING DIODE CIRCUIT HAVING EVEN CURRENT

(75) Inventors: Cheng-Chang Yang, Taoyuan (TW); Guang-Ming Lei, Taoyaun (TW); Yu-Chi Lai, Taoyuan (TW)

(73) Assignee: Asian Power Devices Inc., Taoyuan (TW)

( * ) Notice: Subject to any disclaimer, the term of this patent is extended or adjusted under 35 U.S.C. 154(b) by 132 days.

(21) Appl. No.: 12/001,724

(22) Filed: Dec. 12, 2007

(65) Prior Publication Data

US 2009/0153066 A1 Jun. 18, 2009

(51) Int. Cl.
*H05B 41/00* (2006.01)

(52) U.S. Cl. ..... 315/192; 315/294; 315/297

(58) Field of Classification Search ..... 315/129, 315/169.3, 169.4, 178, 185 R, 185 S, 187, 315/189, 192, 200 A, 200 R, 205, 209 R, 315/210, 224, 244, 250, 277, 291, 294, 297, 315/307, 308, 312, 315, 324, 360, 86, DIG. 7; 324/117 R, 126, 127, 133, 503, 537, 556, 324/713, 768; 327/103, 108, 369, 514, 515, 327/530; 340/514, 638, 639, 641, 651, 652, 340/660, 662, 815.45, 912, 916, 925, 931; 345/82; 361/56; 362/227, 249.05, 249.06, 362/249.14, 249.16, 800

See application file for complete search history.

(56) References Cited

U.S. PATENT DOCUMENTS

2007/0120506 A1* 5/2007 Grant ..... 315/312

* cited by examiner

*Primary Examiner*—Douglas W Owens
*Assistant Examiner*—Jae K Kim
(74) *Attorney, Agent, or Firm*—Chun-Ming Shih

(57) ABSTRACT

A light emitting diode (LED) circuit having even current has multiple LED strings, a current equalizing integrated circuit (IC) and a voltage compensation module. The LED strings are connected to an external power source, and each LED string has a power terminal and a driving terminal. The current equalizing IC has multiple driving pins connected respectively to the driving terminals of the LED strings. The voltage compensation module is connected between the LED strings and the external power source and has a threshold voltage value and multiple input terminals. The input terminals are connected respectively to the driving pins of the current equalizing IC to allow the voltage compensation module rise and send the voltage obtained from the external power source to the LED strings when the voltage compensation module determines any voltage on the driving pins of the current equalizing IC is lower than the threshold voltage value.

2 Claims, 3 Drawing Sheets

LIGHT EMITTING DIODE CIRCUIT HAVING EVEN CURRENT

BACKGROUND OF THE INVENTION

1. Field of the Invention

The present invention relates to a light emitting diode circuit, and more particularly to a light emitting diode circuit having even current.

2. Description of Related Art

Back light modules are commonly used now and may use cold cathode fluorescent lamps (CCFLs) or light emitting diodes (LEDs) as light emitting sources. However, LEDs have some advantages in being light emitting sources of the back light modules, such as saving power, small size, etc. Furthermore, mercury is required for lighting CCFLs, and the mercury is a toxic in nature. Therefore, many manufacturers produce back light modules using LEDs as light emitting sources.

With reference to FIG. 3, a conventional LED circuit of a back light module comprises multiple LED strings (50) and a current equalizing integrated circuit (IC) (60). The LED strings (50) are connected in parallel, and each LED string (50) comprises multiple LEDs (51) connected in series and has a first end and a second end. The first end of each LED string (50) is connected to an external power source. The current equalizing IC (60) is connected to the external power source and the second ends of the LED strings (50), has a bias pin and multiple driving pins and may comprise a multi-transistor current mirror. The bias pin is connected to the external power source to obtain a bias voltage. The driving pins are connected respectively to the second ends of the LED strings (50). The multi-transistor current mirror may be a multi-bipolar junction transistor (BJT) current mirror comprising a reference transistor ($Q_R$) and multiple current transistors (Q). The reference transistor ($Q_R$) has a base terminal, a collector terminal and an emitter terminal. The collector terminal of the reference transistor ($Q_R$) is connected to the bias pin and the base terminal of the reference transistor ($Q_R$). The emitter terminal of the reference transistor ($Q_R$) is connected to ground. The current transistors (Q) have the same characteristics as the reference transistor ($Q_R$), and each current transistor has a base terminal, a collector terminal and an emitter terminal. The base terminals of the current transistors (Q) are connected to the collector terminal of the reference transistor ($Q_R$). The collector terminals of the current transistors (Q) are connected respectively to the driving pins. The emitter terminals of the current transistors (Q) are connected to ground. All current transistors (Q) must operate in its active region so the currents on the driving pins will be the same, and the voltage on the collector terminal of each current transistor (Q) must be higher than an active voltage $V_{C(ACT)}$ of each current transistor (Q) so each current transistor (Q) will operate in its active region.

However, turn-on voltages of all LEDs (51) are not absolutely the same. Larger turn-on voltage of an LED (51) results in a lower voltage input to the collector terminal of the corresponding current transistor (Q). If any voltage input to the collector terminal of the current transistor (Q) is lower than the active voltage $V_{C(ACT)}$ of the current transistor (Q), the current transistor (Q) will not operate in its active region. Accordingly, the current on the driving pin corresponding to the current transistor (Q) not operating in its active region is not the same as the currents on the driving pins corresponding to the current transistors (Q) operating in their active regions. Different currents through the LEDs (51) result in different level of illumination of the LEDs (51).

To overcome the shortcomings, the present invention provides a light emitting diode circuit having even current to mitigate or obviate the aforementioned problems.

SUMMARY OF THE INVENTION

The main objective of the invention is to provide a light emitting diode circuit having even current.

The light emitting diode (LED) circuit in accordance with the present invention comprises multiple LED strings, a current equalizing integrated circuit (IC) and a voltage compensation module. The LED strings are connected to an external power source, and each LED string has a power terminal and a driving terminal. The current equalizing IC has multiple driving pins connected respectively to the driving terminals of the LED strings. The voltage compensation module is connected between the LED strings and the external power source and has a threshold voltage value and multiple input terminals. The input terminals are connected respectively to the driving pins of the current equalizing IC to allow the voltage compensation module to rise and send the voltage obtained from the external power source to the LED strings when the voltage compensation module determines any voltage on the driving pins of the current equalizing IC is lower than the threshold voltage value.

Other objectives, advantages and novel features of the invention will become more apparent from the following detailed description when taken in conjunction with the accompanying drawings.

DETAILED DESCRIPTION OF PREFERRED EMBODIMENT

Figure 1:
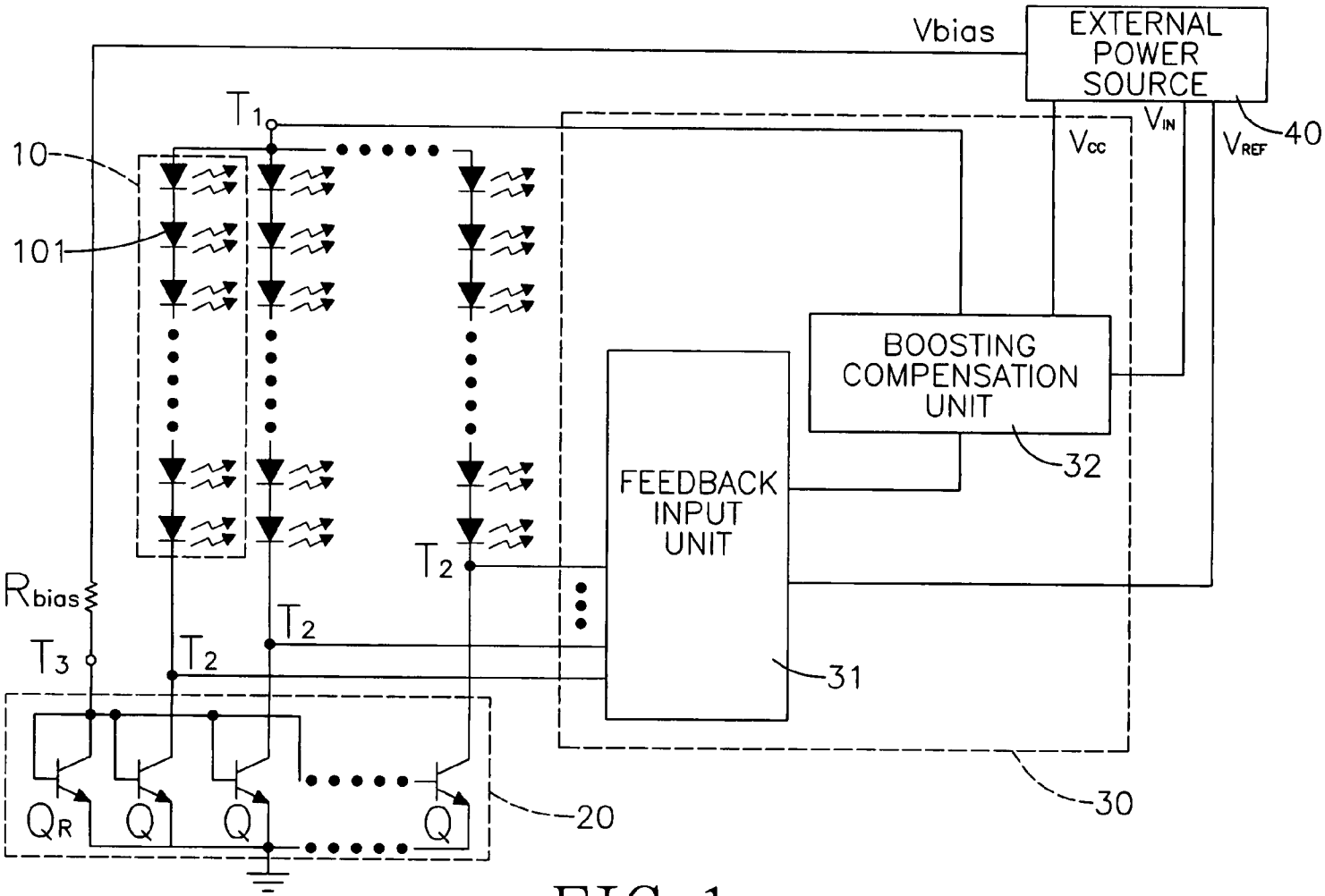
FIG. 1 is a functional block diagram of a light emitting diode (LED) circuit in accordance with the present invention.

With reference to FIG. 1, a light emitting diode (LED) circuit having even current in accordance with the present invention comprises multiple LED strings (10), a current equalizing integrated circuit (IC) (20) and a voltage compensation module (30).

The LED strings (10) are connected to an external power source (40), and each LED string (10) has a power terminal (T1) and a driving terminal and comprises multiple LEDs (101). The power terminals (T1) connect to the external power source (40). The LEDs (101) of each LED string (10) are connected in series.

The current equalizing IC (20) comprises a multi-transistor current mirror and has multiple driving pins (T2) and a bias pin (T3). The driving pins (T2) are connected respectively to the driving terminals of the LED strings (10). The bias pin (T3) is connected to the external power source (40) through a bias resistor ($R_{bias}$) to obtain a bias voltage $V_{bias}$.

The voltage compensation module (30) is connected between the power terminals (T1) of the LED strings (10) and the external power source (40), has a threshold voltage value and multiple input terminals and may comprise a feedback input unit (31) and a boosting compensation unit (32). The threshold voltage value corresponds to the active voltage $V_{C(ACT)}$ of each transistor in the current equalizing IC (20). The input terminals are connected respectively to the driving pins (T2) of the current equalizing IC (20) to obtain feedback voltages $V_{T2}$ on the driving pins (T2) of the current equalizing IC (20), and the voltage compensation module (30) raises and sends the voltage obtained from the external power source (40) to the LED strings (10) when the voltage compensation module (30) determines any of the feedback voltages $V_{T2}$ is lower than the threshold voltage value.

Figure 2:
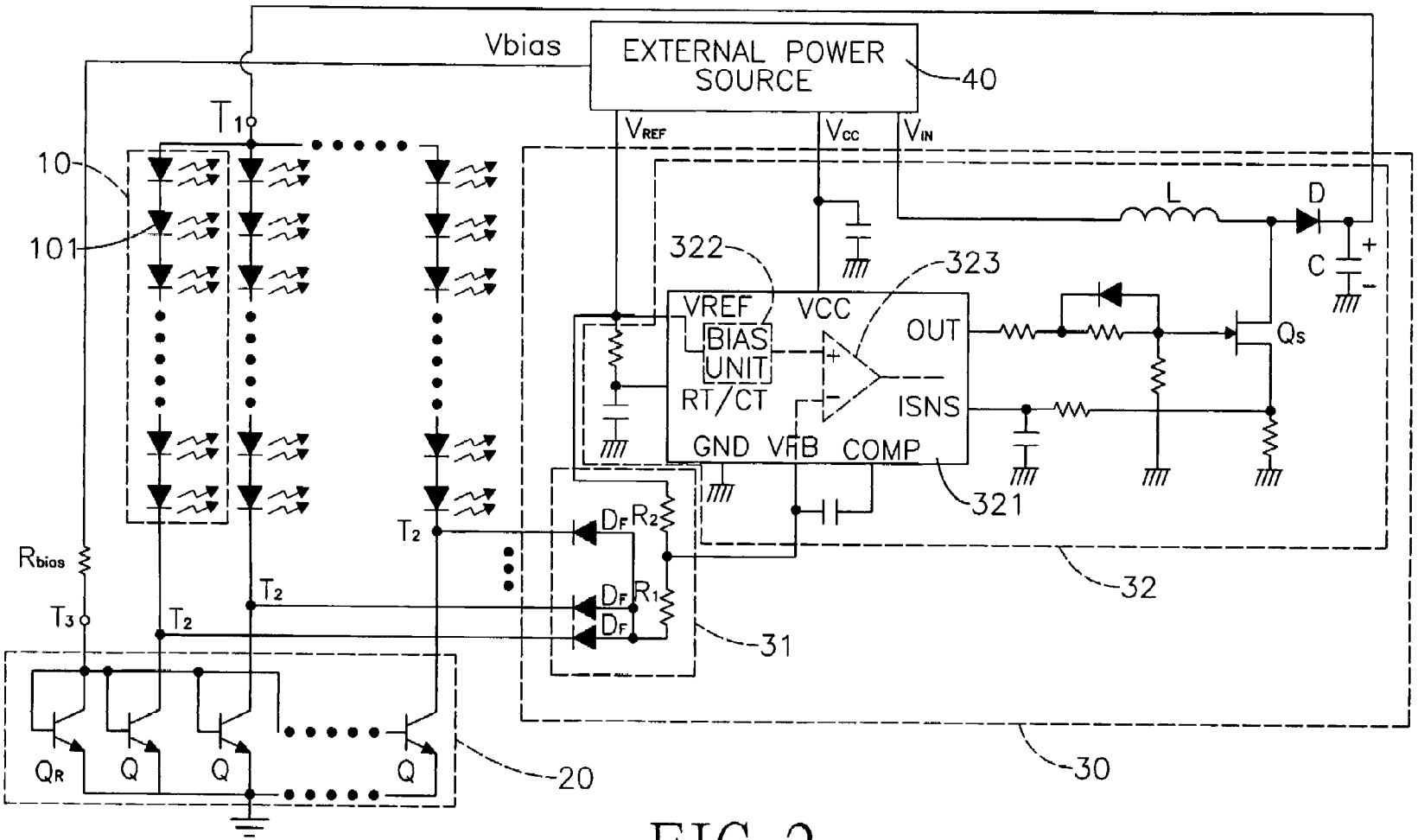
FIG. 2 is a circuit diagram of the LED circuit in FIG. 1.
Figure 3:
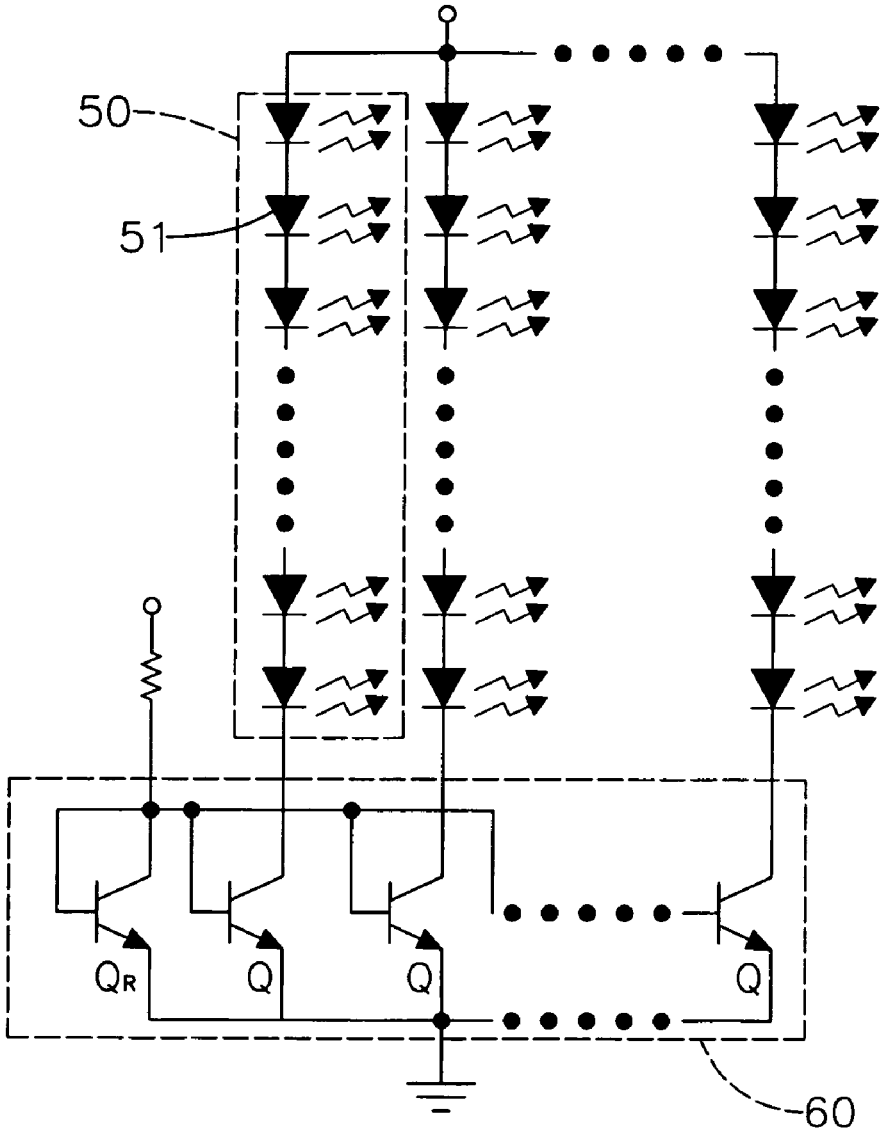
FIG.3 PRIOR ART
FIG. 3 is a circuit diagram of a conventional LED circuit.

With further reference to FIG. 2, the feedback input unit (31) is connected to the driving pins (T2) of the current equalizing IC (20) and the external power source (40) to obtain the feedback voltages $V_{T2}$ and a feedback reference voltage $V_{REF}$ and may comprise multiple diodes ($D_F$), a first resistor (R1) and a second resistor (R2).

The diodes ($D_F$) are connected respectively to the driving pins of the current equalizing IC (20), and each diode ($D_F$) has a negative terminal, a positive terminal and a turn-on voltage value $V_D$. The negative terminals of the diodes ($D_F$) are connected respectively to the driving pins (T2) of the current equalizing IC (20).

The first resistor (R1) has a first end and a second end. The first end of the first resistor (R1) is connected to the positive terminals of the diodes ($D_F$).

The second resistor (R2) has a first end and a second end. The first end of the second resistor (R2) is connected to the external power source (40) to obtain the feedback reference voltage $V_{REF}$. The second end of the second resistor (R2) is connected to the second end of the first resistor (R1) at a node. Furthermore, the divided voltage on the node is $(V_{REF}-V_D-V_{T2})*[R1/(R1+R2)]+(V_D+V_{T2})$, wherein if one of the feedback voltages $V_{T2}$ is reduced, the divided voltage on the node will be reduced too.

The boosting compensation unit (32) is connected to the external power source (40), the feedback input unit (31) and the power terminals (T1) of the LED strings (10) to obtain an input voltage $V_{IN}$, an operating voltage $V_{CC}$ and the feedback reference voltage $V_{REF}$, send the voltage obtained from the external power source (40) to the LED strings (10) when the voltage compensation module (30) determines all of the feedback voltages $V_{T2}$ are lower than the threshold voltage value and raise and send the voltage obtained from the external power source (40) to the LED strings (10) when the voltage compensation module (30) determines any of the feedback voltages $V_{T2}$ is lower than the threshold voltage value. The boosting compensation unit (32) may comprise a pulse width modulation (PWM) controller (321), a switch ($Q_S$), an inductor (L), a rectification diode (D) and a capacitor (C).

The PWM controller (321) has a feedback reference pin (VREF), an operating voltage pin (VCC), an input pin (VFB), a bias unit (322), a comparator (323) and an output pin (OUT).

The feedback reference pin (VREF) is connected to the external power source (40) to obtain the feedback reference voltage $V_{REF}$.

The operating voltage pin (VCC) is connected to the external power source (40) to obtain the operating voltage $V_{CC}$.

The input pin (VFB) is connected to the node between the first and second resistors (R1, R2) to obtain a voltage on the node.

The bias unit (322) is connected to the feedback reference pin (VREF) to transform the feedback reference voltage $V_{REF}$ to a reference voltage. The reference voltage corresponds to the threshold voltage value.

The comparator (323) has a positive terminal, a negative terminal and an output terminal. The positive terminal is connected to the bias unit (322) to obtain the reference voltage. The negative terminal is connected to the input pin (VFB) to obtain the voltage on the node between the first and second resistors (R1, R2).

When the voltage on the node between the first and second resistors (R1, R2) is higher than the reference voltage, the output terminal of the comparator (323) outputs a low level signal. Otherwise, when the voltage on the node between the first and second resistors (R1, R2) is lower than the reference voltage, the output terminal of the comparator (323) outputs a high level signal.

The output pin (OUT) of the PWM controller (321) outputs a standard width pulse if the output terminal of the comparator (323) outputs a low level signal. Otherwise, the output pin (OUT) of the PWM controller (321) outputs a smaller width pulse if the output terminal of the comparator (323) outputs a high level signal.

The switch ($Q_S$) is connected to the output pin (OUT) of the PWM controller (321) and turns on and off based on the pulse output from the PWM controller (321). The pulse having larger width results in the switch ($Q_S$) turning on for a longer time. In addition, the switch ($Q_S$) may be a junction field effect transistor (JFET). The JFET has a gate terminal and a source terminal. The gate terminal of the JFET is connected to the output pin (OUT) of the PWM controller (321).

The inductor (L) has a first end and a second end. The first end of the inductor (L) is connected to the external power source (40) to obtain the input voltage $V_{IN}$. The second end of the inductor (L) is connected to the switch ($Q_S$), such as the source terminal of the JFET.

The rectification diode (D) has a positive terminal and a negative terminal. The positive terminal of the rectification diode (D) is connected to the switch ($Q_S$) and the inductor (L). The negative terminal of the rectification diode (D) is connected to the power terminals (T1) of the LED strings (10). The capacitor (C) is connected to the negative terminal of the rectification diode (D) and the power terminals (T1) of the LED strings (10), is charged from the input voltage $V_{IN}$ when the switch ($Q_S$) is turned off and discharges to the LED strings (10) when the switch ($Q_S$) is turned on.

When any feedback voltage $V_{T2}$ on the driving pins (T2) of the current equalizing IC (20) is lower than the active voltage $V_{C(ACT)}$ of the transistor in the current equalizing IC (20), the voltage on the node between the first and second resistors (R1, R2) consequentially becomes lower. Lower voltage on the node between the first and second resistors (R1, R2) results in the output pin (OUT) of the PWM controller (321) outputting a small width pulse. The small width pulse results in the switch ($Q_S$) turning on for a shorter time so a charging period of the capacitor (C) is longer than a discharging period of the capacitor (C). Consequently, longer charging period and shorter discharging period of the capacitor (C) allow the capacitor (C) to store more electric energy and discharge more electric energy to the LED strings (10). The feedback voltages $V_{T2}$ on the driving pins (T2) of the current equalizing IC (20) will then increase to higher than the active voltage $V_{C(ACT)}$ of the transistor in the current equalizing IC (20). Therefore, the current equalizing IC (20) operates normally to keep the illuminations of the all LEDs (101) being the same.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A light emitting diode (LED) circuit having even current comprising:

multiple LED strings being connected to an external power source, and each LED string comprising multiple LEDs connected in series together and having a power terminal connecting to the external power source; and a driving terminal;

a current equalizing integrated circuit (IC) comprising a multi-transistor current mirror and having multiple driving pins being connected respectively to the driving terminals of the LED strings; and a bias pin being connected to the external power source through a bias resistor to obtain a bias voltage; and a voltage compensation module being connected between the power terminals of the LED strings and the external power source and having a threshold voltage value corresponding to an active voltage of each transistor in the current equalizing IC; and multiple input terminals being connected respectively to the driving pins of the current equalizing IC to obtain feedback voltages on the driving pins of the current equalizing IC to allow the voltage compensation module raising and sending the voltage obtaining from the external power source to the LED strings when the voltage compensation module determines any of the feedback voltages is lower than the threshold voltage value wherein the voltage compensation further comprises a feedback input unit being connected to the driving pins of the current equalizing IC and the external power source to obtain the feedback voltages and a feedback reference voltage; and a boosting compensation unit being connected to the external power source, the feedback input unit and the power terminals of the LED strings to obtain an input voltage, an operating voltage and the feedback reference voltage, send the voltage obtained from the external power source to the LED strings when the voltage compensation module determines all of the feedback voltages are lower than the threshold voltage value and raise and send the voltage obtaining from the external power source to the LED strings when the voltage compensation module determines any of the feedback voltages is lower than the threshold voltage value; and wherein the feedback input unit further comprises multiple diodes connected respectively to the driving pins of the current equalizing IC, and each diode having a negative terminal being connected respectively to the driving pins; and a positive terminal;

a first resistor having a first end being connected to the positive terminals of the diodes; and a second end; and a second resistor having a first end being connected to the external power source to obtain the feedback reference voltage; and a second end being connected to the second end of the first resistor at a node.

2. The LED circuit as claimed in claim 1, wherein the boosting compensation unit further comprises a pulse width modulation (PWM) controller having a feedback reference pin being connected to the external power source to obtain the feedback reference voltage;

an operating voltage pin being connected to the external power source to obtain the operating voltage;

an input pin being connected to the node between the first and second resistors to obtain a voltage on the node;

a bias unit being connected to the feedback reference pin to transform the feedback reference voltage to a reference voltage corresponding to the threshold voltage value;

a comparator having a positive terminal being connected to the bias unit to obtain the reference voltage;

a negative terminal being connected to the input pin to obtain the voltage on the node between the first and second resistors; and an output terminal outputting a low level signal and a high level signal respectively when the voltage on the node between the first and second resistors is higher than the reference voltage and when the voltage on the node between the first and second resistors is lower than the reference voltage; and an output pin outputting a standard width pulse and a small width pulse respectively when the output terminal of the comparator outputs a low level signal and the output terminal of the comparator outputs a high level signal;

a switch being connected to the output pin of the PWM controller and turning on and off based on the pulse outputted from the PWM controller;

an inductor having a first end being connected to the external power source to obtain input voltage; and a second end being connected to the switch;

a rectification diode having a positive terminal being connected to the switch and the inductor; and a negative terminal being connected to the power terminals of the LED strings; and a capacitor being connected to the negative terminal of the rectification diode and the power terminals of the LED strings, being charged from the input voltage when the switch is turned off and discharging to the LED strings when the switch is turned on.

* * * * *